US007553172B2

(12) United States Patent
Chiu et al.

(10) Patent No.: US 7,553,172 B2
(45) Date of Patent: Jun. 30, 2009

(54) USB CONNECTOR

(75) Inventors: Ronald Chiu, Hong Kong (HK); Chee Hong Lee, Guangzhou Province (CN); Wing Hon Tsang, Hong Kong (HK)

(73) Assignee: Thomson Licensing, Boulogne-Billancourt (FR)

( * ) Notice: Subject to any disclaimer, the term of this patent is extended or adjusted under 35 U.S.C. 154(b) by 61 days.

(21) Appl. No.: 11/791,290

(22) PCT Filed: Nov. 22, 2005 (Under 37 CFR 1.47)

(86) PCT No.: PCT/EP2005/056133

§ 371 (c)(1), (2), (4) Date: Oct. 26, 2007

(87) PCT Pub. No.: WO2006/061321

PCT Pub. Date: Jun. 15, 2006

(65) Prior Publication Data

US 2008/0254680 A1 Oct. 16, 2008

(30) Foreign Application Priority Data

Dec. 9, 2004 (EP) ..... 04300864

(51) Int. Cl.
*H01R 13/44* (2006.01)

(52) U.S. Cl. ..... 439/131

(58) Field of Classification Search ..... 439/131, 439/135, 142, 145, 173, 174, 217, 218; 139/173
See application file for complete search history.

(56) References Cited

U.S. PATENT DOCUMENTS 5,135,406 A * 8/1992 Ishikawa ..... 439/131
5,496,186 A * 3/1996 Dobbelaere et al. ..... 439/79
6,923,666 B1 * 8/2005 Liao ..... 439/172

(Continued)

FOREIGN PATENT DOCUMENTS

JP 2003-217728 7/2003

OTHER PUBLICATIONS

Search Report Dated Jan. 26, 2006.

*Primary Examiner*—Alexander Gilman
(74) *Attorney, Agent, or Firm*—Robert D. Shedd; Jeffrey M. Navon

(57) ABSTRACT

A USB plug comprises a shell, a stationary port, upper and lower sliders and a levering device. The shell has an opening formed at a front end thereof and two pairs of terminal pins connected at a rear end thereof. The stationary port extending horizontally is fixed at a middle of the rear end of the shell, each side of the port being provided with two pairs of contacts in electrically connection with the terminal pins. The upper and lower sliders respectively have first sides thereof facing towards each other and second sides thereof being slidable along upper and lower sidewalls of the shell, each one slider having two metal contacts provided on the first side thereof corresponding to the contacts of the stationary port. The levering device is operatively provided between the upper and lower sliders in order to alternately shift the upper and lower sliders by means of an external intrusion force exerted on one of the upper and lower sliders. Advantageously the USB plug is adapted for connecting with a conventional USB socket in both upside and upside down orientation.

5 Claims, 5 Drawing Sheets

U.S. PATENT DOCUMENTS 6,981,887 B1 * 1/2006 Mese et al. ..... 439/244
7,001,192 B1 * 2/2006 Yeh ..... 439/131
7,094,086 B2 * 8/2006 Teicher ..... 439/173
7,160,125 B1 * 1/2007 Teicher ..... 439/173
7,363,947 B2 * 4/2008 Teicher ..... 139/173
2004/0103228 A1 * 5/2004 Kao ..... 710/72

* cited by examiner (a)

(b)

USB CONNECTOR

This application claims the benefit, under 35 U.S.C. § 365 of International Application PCT/EP2005/056133, filed Nov. 22, 2005, which was published in accordance with PCT Article 21(2) on Jun. 15, 2006 in English and which claims the benefit of European patent application No. 04300864.8, filed Dec. 9, 2004.

The present invention relates to a USB connector, particularly to a USB plug which is adapted for reversibly connecting with a conventional USB socket.

USB standard connectors are widely used in the computer and electronic consumer products. It can be easily used to connect a peripheral device with a host computer without rebooting of the host computer and ensure fast transmission rate. Due to the special configuration of the USB connectors, a USB plug can only be inserted into a USB socket in a given orientation. A mark is usually provided on an external surface to help user to identify the correct plug-in orientation, however, majority of users still often find it is difficult to recognize the correct plug-in orientation, because the metal shell of the USB plug has identical shape formed at opposite sides.

As shown in FIGS. 1*a* and 1*b* a conventional USB socket 80 generally comprises a body 81, a plate member 82, a shell 83 and two pairs of spring contacts 84. The plate member 82 is integrally formed with the body 81, and extruded from the body 81 towards an opening end of the shell 83. The shell 83 is usually metal-made and encloses around the whole body 81 and the plate member 82. The two pairs of spring contacts 84 are fixed in the plate member 82 and arranged in parallel along a lower side of the plate member 82. An upper space 85 and a lower space 86 are respectively defined in the USB socket 80 between the plate member 82 and the shell 83.

FIGS. 2*a* and 2*b* illustrate a conventional USB plug 90, which comprises a body 91, a plate member 92, a shell 93 and two pairs of electrode contacts 94. The plate member 92 is integrally formed at a lower side of the body 91, and extruded from the body 91 towards an opening end of the shell 93. The shell 93 is usually metal-made and encloses around the whole body 91 and the plate member 92. The electrode contacts 94 are fixed in the plate member 92 and the body 91 are arranged in parallel along an upper side surface of the plate member 92 corresponding to the spring contacts 84 of the USB socket 80. A space 95 is defined in the USB plug 90 between the plate member 92 and the shell 93.

When the conventional USB plug 90 is connected to the conventional USB socket 80 as shown in FIG. 3, first the front end of the USB plug 90 is inserted into the upper and lower spaces 85 and 86 of the USB socket 80. The plate member 82 of the USB socket 80 is inserted into the space 95 of the USB plug 90. The electrode contacts 94 of the USB plug 90 are electrically connected to the corresponding spring contacts 84 of the USB socket 80.

It can be noted that there is only one single plate member 92 being nonsymmetrically extruded from the lower side of the body 91, therefore the USB plug 90 can only be correctly connected to the USB socket 80 in an upside plug-in orientation as shown in FIG. 3. If one of the USB socket 80 and the USB plug 90 is reversed, for example, when the USB socket 80 remains in the upside orientation as shown in FIGS. 1 and 3 and the USB plug 90 is reversed into an upside down orientation, or alternatively when the USB plug 90 remains in the upside orientation as shown in FIGS. 2 and 3 and the USB socket 80 is reversed into an upside down orientation, a correct connection can not be established between the USB plug 90 and the USB socket 80.

In order to identify the correct plug-in orientation of the USB connectors, usually an identify mark 96 is provided on an external surface of the USB plug 90 as can be seen from FIGS. 2 and 3. However, sometimes the connection between the USB connectors is still unavoidable from incorrect operations. If an incorrect plug-in operation is acted under a compelling force, permanent damages on the hardware of the USB connectors may occur.

In order to solve the above problems of the conventional USB connectors, a Japanese patent of application No. JP 2003-217728 had disclosed an improved USB socket which is adapted for connecting with a conventional standard USB plug in a reversible way to overcome the above defects.

As shown in FIG. 4, a first example according to the above patent provides a USB socket 200, which comprises a body 201, a plate member 202, a shell 203 and spring contacts 204. Wherein the plate member 202 is integrally formed at a middle of the body 201 and extrude from the body 201 towards an opening end of the shell 203. The shell 203 encloses around the whole body 201 and the plate member 202. More particularly, each one of upper and lower sides of the plate member 202 is provided with two pairs of spring contacts 204. An upper space 205 and a lower space 206 are symmetrically defined in identical shape in the USB socket 200 at opposite sides of the plate member 202. Due to the symmetrical configuration of the USB socket 200, when a user intends to connect the conventional USB plug 90 to the USB socket 200 as shown in FIG. 4, he/she can just adjust the vertical position of the USB plug 90 in order to make the space 95 of the USB plug 90 to be in line with the plate member 202 of the USB socket 200 no matter whether the plug-in orientation of the USB plug 90 is in an upside or an upside down orientation, that is to say, the conventional USB plug 90 can be reversibly connected to the USB socket 80 in both upside and upside down plug-in orientations.

However the defects of the above described USB socket 200 is that the opening size of the shell 203 of the USB socket 200 is unmatched to the conventional standard USB plug 90, and the vertical position of the USB plug 90 have to be adjusted in order to make the space 95 of the USB plug 90 in line with the plate member 202 of the USB socket 200. Additionally, the metal-made shell 93 of the USB plug 90 may cause the spring contacts 204 of the USB socket 200 to be short cut during the plug-in connection, therefore the reliability of this type of USB socket 200 is low.

As shown in FIGS. 5, 6 and 7, another example according to the above patent provides a USB socket 300 comprising an upper slide 302 and a lower slider 302' slidably received in a shell 303. A pair of upper spring contacts 304 and a pair of lower spring contacts 304' are respectively provided on a lower side of the upper slider 302 and an upper side of the lower sliders 302'. In particular, two springs 305 and 305' are respectively connected at rear ends of the upper and lower sliders 302 and 302' to provide compressive resilient energy to the sliders 302 and 302'.

When the USB plug 90 is connected to the USB socket 300 in an upside plug-in orientation as shown in FIG. 6, the upper slider 302 will be inserted into the space 95 of the USB plug 90, and the lower slider 302' will be retracted inwardly by the intrusion of the plate member 92 of the USB plug 90. When the USB plug 90 is connected to the USB socket 300 in a reversed upside down plug-in orientation as shown in FIG. 7, the lower slider 302' will be inserted into the space 95 of the USB plug 90, and the upper slider 302 will be retracted inwardly by the intrusion of the plate member 92 of the USB plug 90. If the USB plug 90 is plugged out from the USB socket 300, the retracted slider 302 or 302' will return to the original position by the resilience of the spring 305 or 305'.

However, the structure of the USB socket 300 of the above patent is very complicated, so the manufacturing cost must be expensive, and moreover it does not illustrate a reliable electrical connection between the spring contacts 304 and 304' and terminal pins of the USB socket 300.

Therefore, there exists an object for the present invention to provide an improved type of USB connector in order to solve the problems and defects of the prior art.

The present inventions provides a new type of USB connector, and more particularly a USB plug, which is adapted to connect with a standard USB socket. The USB plug of the present invention comprises a shell, a stationary port, an upper slider, a lower slider and a levering device.

Wherein the shell has an opening formed at a front end thereof and two pairs of terminal pins connected at a rear end thereof.

The stationary port extending horizontally is fixed at a middle of the rear end of the shell. Each one of upper and lower sides of the stationary port has two pairs of contacts provided thereon corresponding to and electrically connected to the two pairs of terminal pins in respective.

The upper and lower sliders being slidably received in the shell have first sides thereof facing towards each other and second sides thereof being slidable along upper and lower sidewalls of the shell, each one of the upper and lower sliders having two pairs of metal contacts provided on the first side thereof corresponding to the two pairs of contacts provided on the stationary port.

The levering device is operatively provided between the upper and lower sliders in order to alternately shift the upper and lower sliders by an external intrusion force exerted on one of the upper and lower sliders, whereby when the USB plug is connected into a conventional standard USB socket in an upside or an upside down orientation, one of the sliders is retracted inwardly by an intrusion force exerted thereon while another one of the sliders is shifted outwardly by means of the levering device.

Advantageously, the USB plug is adapted for connecting with a conventional standard USB socket in both upside and upside down orientation.

In one embodiment the levering device comprises at least one gear operatively engaged between at least one upper gear rail and at least one lower gear rail.

Preferably the at least one upper gear rail and the at least one lower gear rail are integrated on the first sides of the upper and lower sliders In one embodiment of the present invention, outside pairs of metal contacts of the sliders intended for power supply extend longer towards the front end of the shell than inside pairs of the metal contacts of the sliders intended for signal communication extend, and outside pairs of contacts of the stationary port for power supply extend longer intended towards the front end of the shell than inside pairs of the contacts of the stationary port intended for signal communication extend.

Advantageously, the power supply connection between the USB plug and a conventional USB socket is established before the signal communication connected, and the signal communication disconnected before the power supply connection is disconnected.

FIG. 1*a* is a schematic front view of a conventional USB socket;

FIG. 1*b* is a schematic side view with partial cross section of the conventional USB socket as shown in FIG. 1*a;*

FIG. 2*a* is a schematic front view of a conventional USB plug;

FIG. 2*b* is a schematic side view with partial cross section of the conventional USB socket as shown in FIG. 2*a;*

Figure 14:
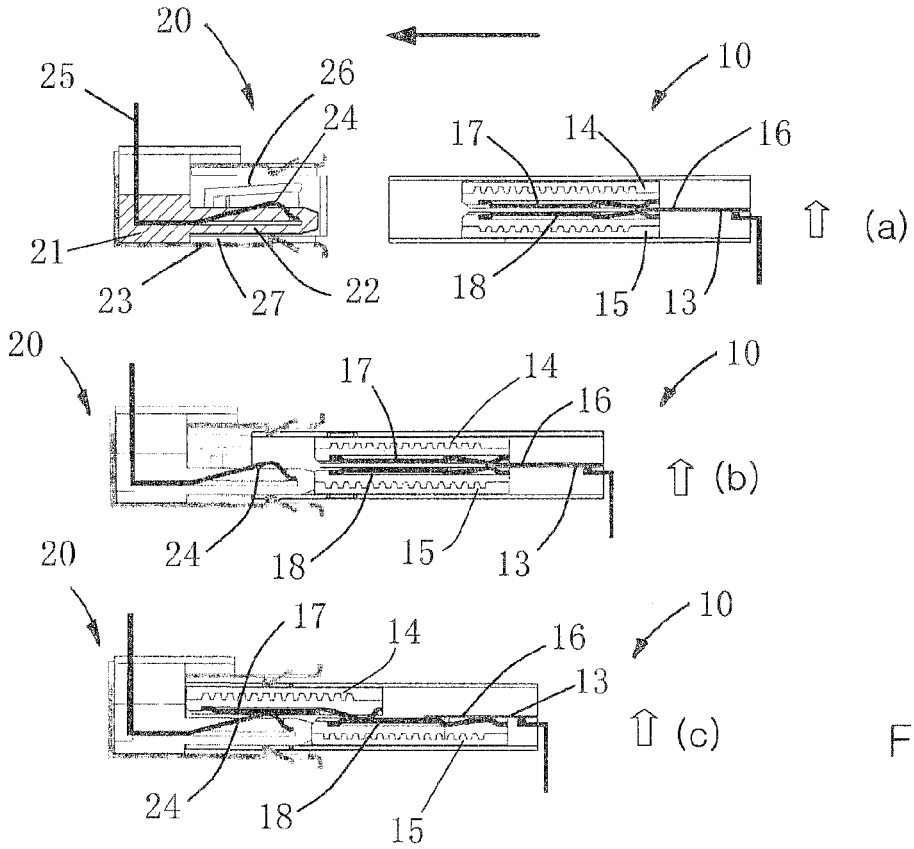
Figure 15:
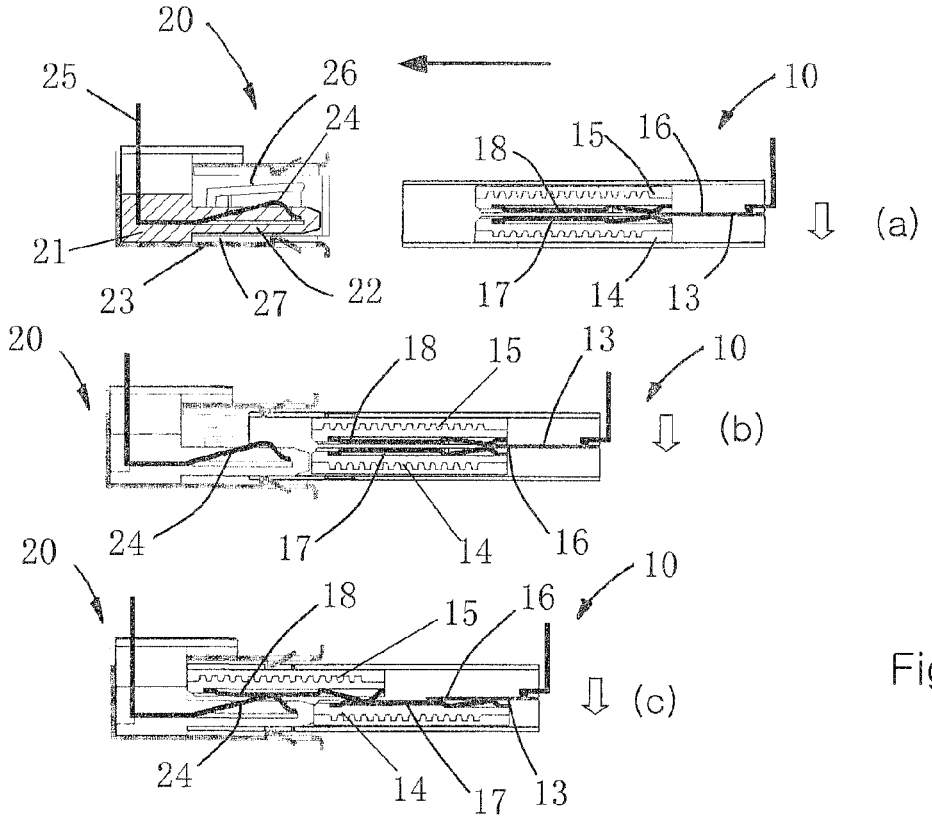

FIG. 13*a* is a schematic side view showing the USB plug according to the present invention to be connected to a conventional standard USB socket in an upside plug-in orientation;

FIG. 13*b* is a schematic side view showing the USB plug according to the present invention to be connected to the conventional standard USB socket in an upside down plug-in orientation;

FIGS. 14*a*-14*c* are schematic views showing steps of connecting the USB plug to the conventional standard USB socket in the upside plug-in orientation; and FIGS. 15*a*-15*c* is a schematic view showing steps of connecting the USB plug to the conventional standard USB socket in the upside down plug-in orientation.

Figure 1A:
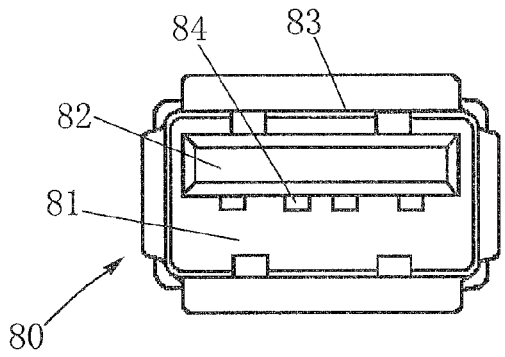
Figure 2A:
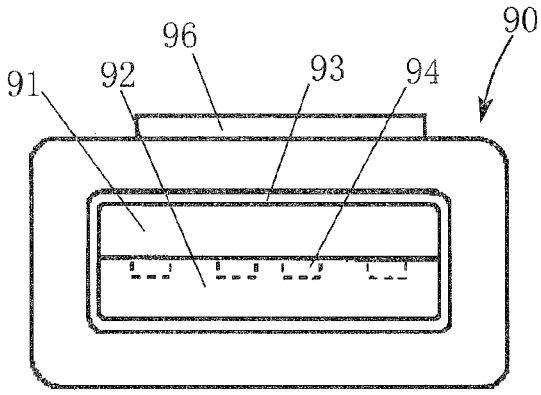
Figure 1B:
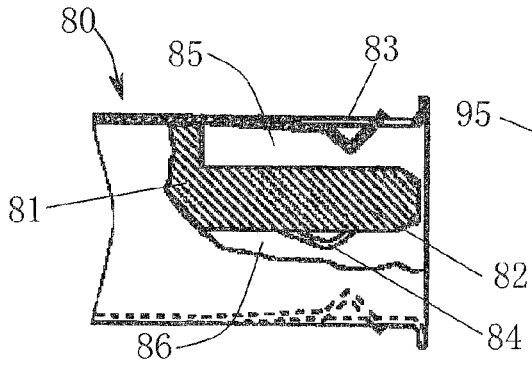
Figure 2B:
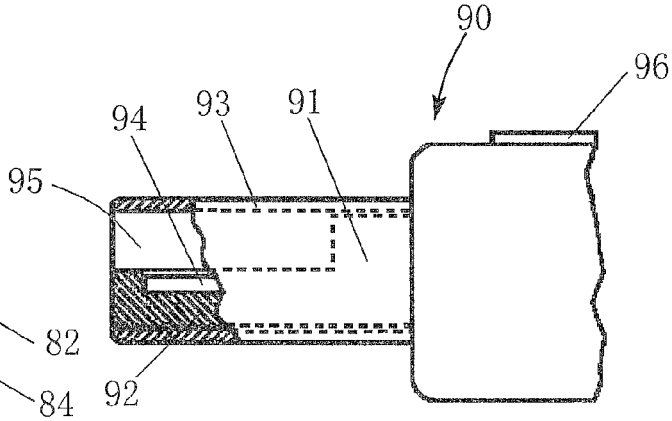
Figure 3:
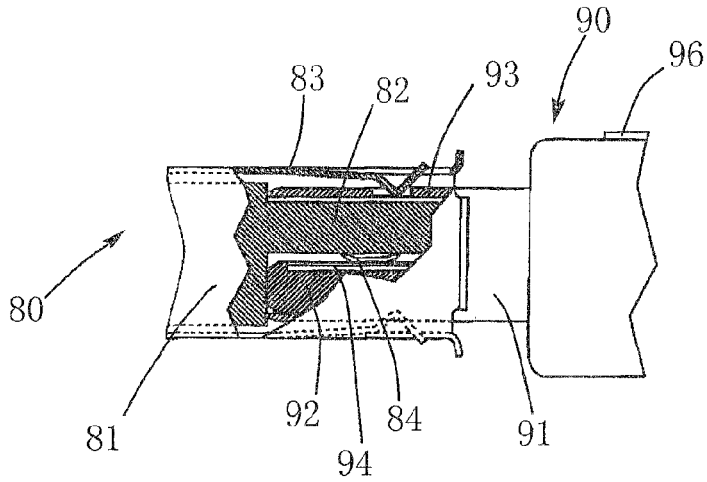
Fig 3 Prior Art
FIG. 3 is a schematic view showing the conventional USB plug being plugged into the conventional USB socket.
Figure 4:
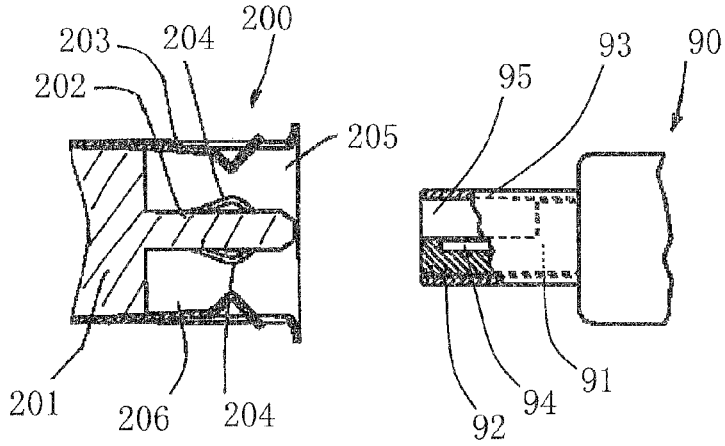
FIG. 4 is a schematic view showing a first example of a USB socket of a prior art to be used to connect a conventional USB plug in a reversible way.
Figure 5:
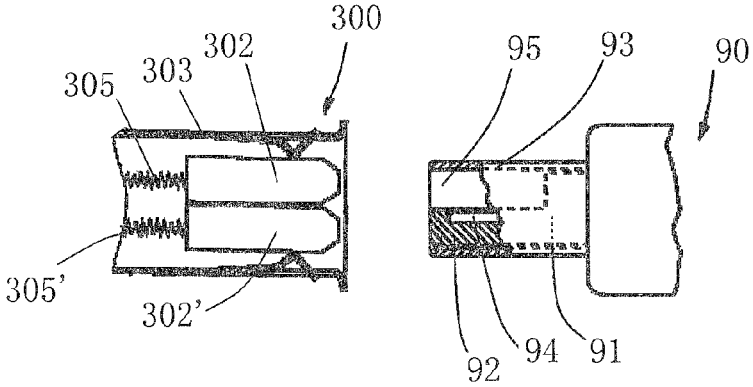
FIG. 5 is a schematic view showing a second example of a USB socket of the prior art to be used to connect a conventional USB plug in a reversible way.
Figure 6:
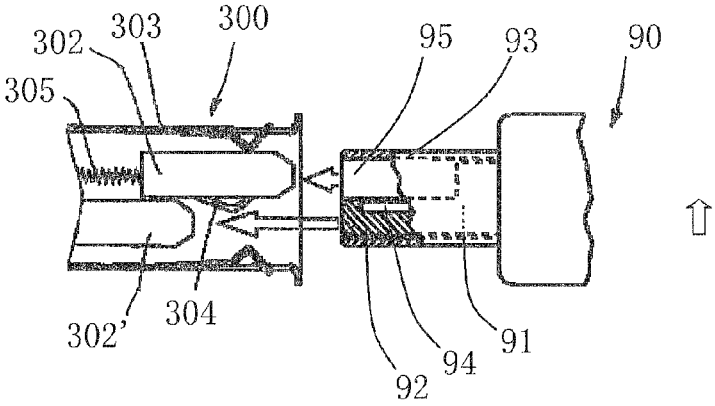
FIG. 6 is a schematic view showing the USB socket of FIG. 5 connecting to the USB plug in an upside plug-in orientation.
Figure 7:
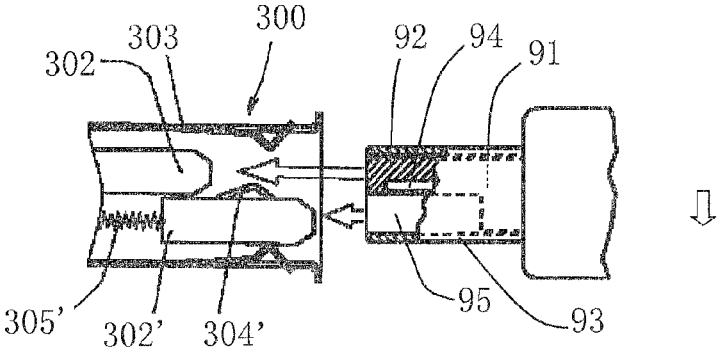
Fig 7 Prior Art
FIG. 7 is a schematic view showing the USB socket of FIG. 5 connecting to the USB plug in an upside down plug-in orientation.
Figure 8:
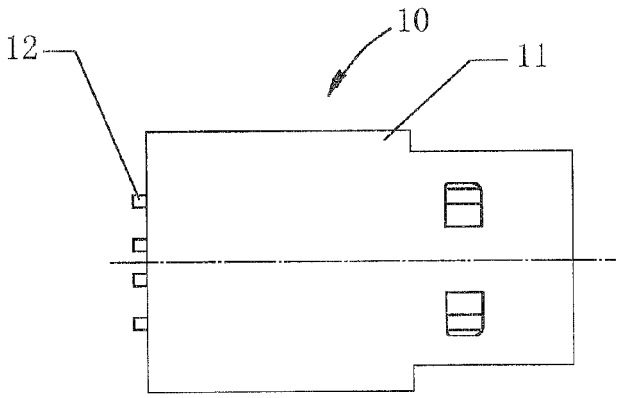
FIG. 8 is a schematic plan view of a USB plug according to the present invention.
Figure 9:
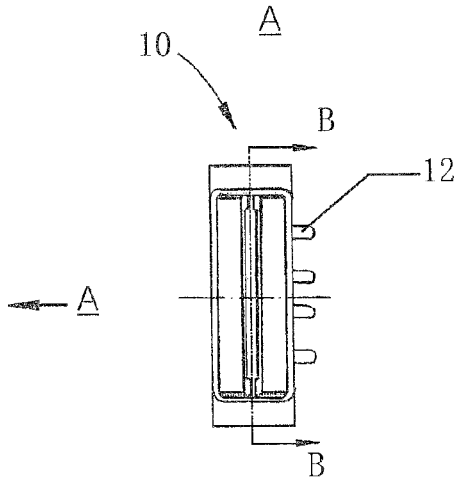
FIG. 9 is a schematic side view of the USB plug shown from A direction indicated in FIG. 8.

As shown in FIGS. 8 and 9, an improved USB plug 10 according to the present invention comprises a shell 11 having an opening formed at a front end thereof and two pairs of terminal pins 12 connected to a rear end thereof.

Figure 10:
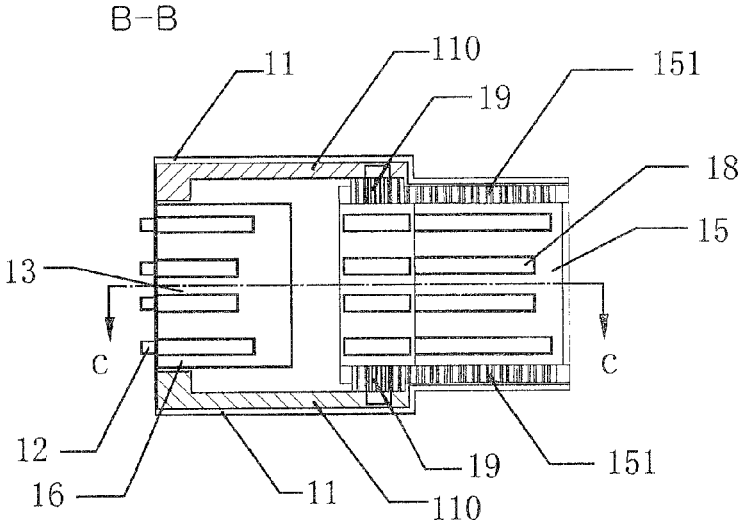
FIG. 10 is a schematic cross sectional view of the USB plug according to the present invention along line B-B indicated in FIG. 9.

It can be seen more clearly from FIG. 10 that two insulating plates 110 are respectively fitted at opposite sides of the rear end portion of the shell 11. Now with reference to FIGS. 10 and 11, the USB plug 10 of the present invention further comprises a stationary port 13 provided at the rear end of the shell 11, an upper slider 14 and a lower slider 15 slidably received in the shell 11, and an adaptive levering means operatively provided between the upper slider 14 and lower slider 15.

The stationary port 13 is formed in a thin piece member extended horizontally and fixed at a middle of the rear end of the shell 11. Each one side of the stationary port 13 has two pairs of contacts 16 provided thereon in electrical connection with the pair of terminal pins 12. Wherein two outside pairs of contacts 16 are intended for power supply, two inside pairs of contacts 16 are intended for signal communication. The two outside pairs of contacts 16 extend longer towards the front end of the shell 11 than the two inside pairs of contacts 16 extend.

Figure 11:
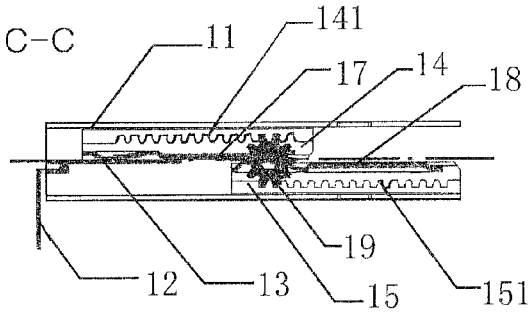
FIG. 11 is a schematic cross sectional view of the USB plug according to the present invention along line C-C indicated in FIG. 10.
Figure 12:
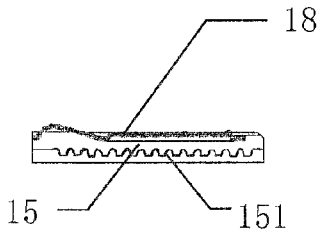
FIG. 12 is a schematic side view of a slider of the USB plug according to the present invention.

The upper and lower sliders 14 and 15 are integrally formed plate members made of insulating material in identical configuration. As shown in FIGS. 10 and 11 with reference to FIG. 12, the upper and lower sliders 14 and 15 respectively have first sides thereof facing towards each other and second sides thereof being slidable along upper and lower sidewalls of the shell 11.

The upper slider 14 has two pairs of metal contacts 17 provided on the first side thereof corresponding to the contacts 16, and the lower slider 15 also has two pair of metal contacts 18 provided on the first side thereof corresponding to the contacts 16. Wherein outside pairs of the metal contacts 17 and 18 are intended for power supply and inside pairs of the metal contacts 17 and 18 are intended for signal communication. Each one of the metal contacts 17 and 18 has a fixed end portion secured on the first sides of the sliders 14 and 15 and a curved spring end portion extending towards the rear end of the shell 11. The fixed end portions of each outside pairs of the metal contacts 17 and 18 extend longer towards the front end of the shell 11 than the fixed end portions of the inside pairs of metal contact 17 and 18 extend.

One embodiment of the levering means according to the present invention includes a pair of gears 19, which are operatively provided between the first sides of the upper and lower sliders 14 and 15 at two opposite edges. Correspondingly, a pair of upper gear rails 141 and a pair of lower gear rails 151 are respectively provided on the first sides of the upper and lower sliders 14 and 15 at opposite edges. The pair of gears 19 are rotatably mounted in shell 11 and operatively engaged between the pair of upper gear rails 141 and the pair of lower gear rails 151. The pair of upper gear rails 141 are attached to the upper slider 14, and the pair of lower gear rails 151 are attached to the lower slider 15, therefore, when the pairs of upper and lower gear rails 141 and 151 driven by the pair of gears 19 in one rotation direction, the upper and lower sliders 14 and 15 will be driven to move in two opposed directions respectively.

In such a way, the upper and lower sliders 14 and 15 are enabled to be alternately shifted by an external intrusion force exerted on one of the upper and lower sliders. When one of the sliders 14 and 15 is retracted inwardly by an external intrusion force, this external intrusion force exerted on the retracted slider in inward direction will be transferred into an press force exerted on another one of the sliders 14 and 15 in outward direction through the gear 19 and gear rails 141 and 151, therefore the another one of the sliders 14 and 15 will be shifted outwardly by means of the levering device.

In one embodiments of the levering means, the upper and lower gear rails 141 and 151 are integrated on the first side of the sliders 14 and 15 at opposite edges. However, the gear rails 141 and 151 may also be formed separately from the slider 14 and 15. It can be understood by those skilled in the art, the levering device may be any practical mechanism which enables the upper and lower sliders 14 and 15 to be alternately shifted within the shell 11.

Figure 13:
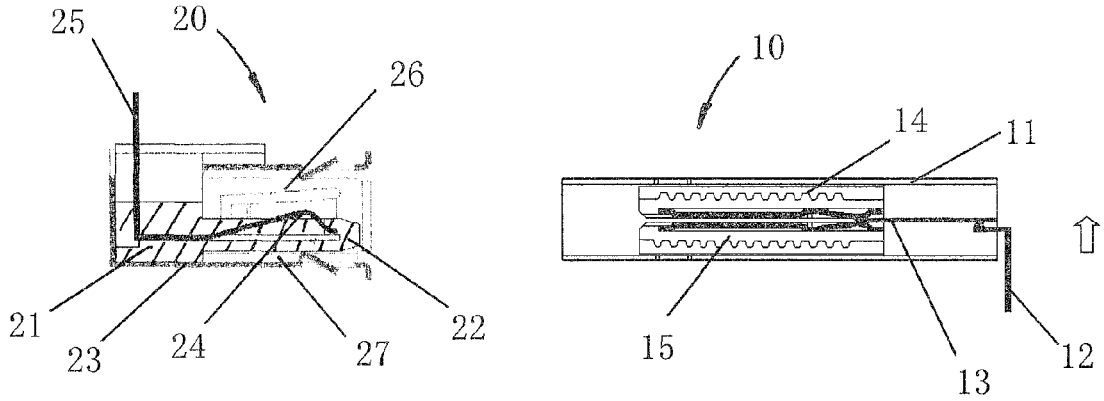
Figure 13:
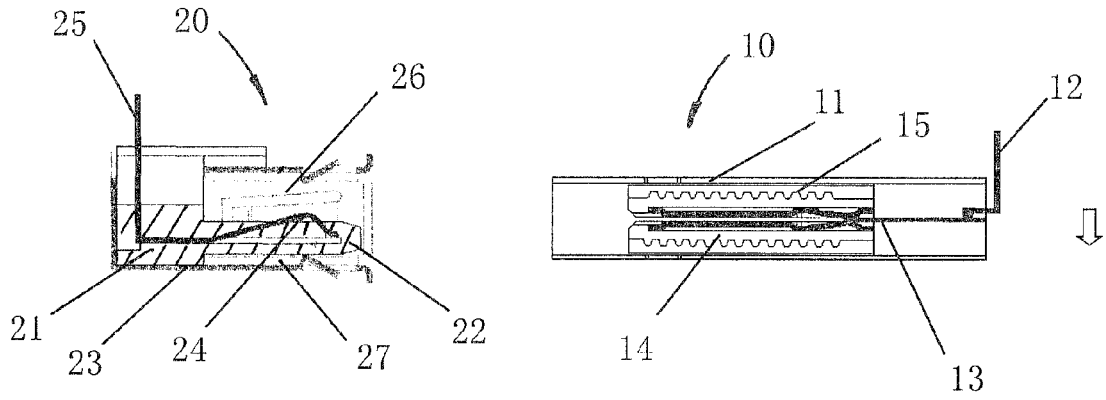

As shown in FIG. 13, a conventional standard USB socket 20 may generally comprise a main body 21, a plate member 22, a shell 23, two pairs of spring contacts 24 and two pairs of terminal pins 25 electrically connected to the two pairs of spring contacts 24. An upper space 26 and a Lower space 27 are respectively defined in the USB socket 20 between the plate member 22 and the shell 23.

When the USB plug 10 of the invention is connected to the conventional USB socket 20 in an upside orientation as shown in FIG. 13*a*, or in an upside down orientation as shown in FIG. 13*b*, it can be seen that due to the identical configuration of the upper and lower sliders 14 and 15, there is no obstacle for both upside and upside down plug-in connection orientation. The arrows shown in the drawings respectively indicate the upside and upside down orientations of plug-in connection orientation of the USB plug 10.

FIGS. 14*a*, 14*b* and 14*c* shows the plug-in steps of connecting the USB plug 10 of the present invention to the conventional USB socket 20 in the upside orientation. The horizontal arrows show the moving direction of the USB plug 10.

First, the front end portion of the shell 11 of the USB plug 10 is inserted into the upper and lower spaces 26 and 27 of the shell 23 of the USB socket 20. Then when the USB plug 10 is continuously moving forwards to the USB socket 20, the plate member 22 of the USB socket 20 is continuously intruding into the shell 11 of the USB plug 10. The lower slider 15 forced by the plate member 22 of the USB socket 20 is retracted inwardly till the lower slider 15 moves to the innermost position, in which the spring contacts 18 of the lower slider 15 are electrically connected with corresponding contacts 16 of the stationary port 13, and synchronously the upper slider 14 is shifted outwardly by means of the levering device till the upper slider 14 moves to the outermost position, in which the spring contacts 24 of the USB socket 20 are electrically connected with the metal contacts 17 of the upper slider 14.

In this way, the spring end portions of the metal contacts 18 of the lower slider 15 are electrically connected with the contacts 16 of the stationary port 13, the spring end portions of the metal contacts 17 of the upper slider 14 are electrically connected with the fixed end portion of the metal contacts 18 of the lower slider 15, and the spring contacts 24 of the USB socket 20 are electrically connected with the fixed end portions of the metal contacts 17 of the upper slider 14. Therefore an electrical connection is built up between the USB plug 10 and the USB socket 20 through the upper slider 14 which served as a bridge between the lower slider 15 and the plate member 22 of the USB socket 20.

FIGS. 15*a*, 15*b* and 15*c* shows the plug-in steps of connecting the USB plug 10 of the present invention to the USB socket 20 in the upside down orientation. The horizontal arrows show the moving direction of the USB plug 10.

First, the front end portion of the shell 11 of the USB plug 10 is inserted into the upper and lower spaces 26 and 27 of the shell 23 of the USB socket 20. Then when the USB plug 10 is continuously moving forwards to the USB socket 20, the plate member 22 of the USB socket 20 is continuously intruding into the shell 11 of the USB plug 10. The upper slider 14 forced by the plate member 22 of the USB socket 20 is retracted inwardly till the upper slider 14 moves to the innermost position, in which the spring contacts 17 of the upper slider 14 are electrically connected with corresponding contacts 16 of the stationary port 13, and synchronously the lower slider 15 is shifted outwardly by means of the levering devices till the lower slider 15 moves to the outermost position, in which the spring contacts 24 of the USB socket 20 are electrically connected with the metal contacts 18 of the lower slider 15.

In this way, the spring end portions of the metal contacts 17 of the upper slider 14 are electrically connected with the contacts 16 of the stationary port 13, the spring end portions of the metal contacts 18 of the lower slider 15 are electrically connected with the fixed end portion of the metal contacts 17 of the upper slider 14, and the spring contacts 24 of the USB socket 20 are electrically connected with the fixed end portions of the metal contacts 18 of the lower slider 15. Therefore, an electrical connection is built up between the USB plug 10 and the USB socket 20 through the lower slider 15 which is served as a bridge between the upper slider 14 and the plate member 22 of the USB socket 20.

Advantageously, because the fixed end portions of the outside pairs of metal contacts 14 and 15 extend longer towards the front end of the shell 11 than the fixed end portions of the inside pairs of contacts 14 and 15 extend, and the outside pairs of the contacts 16 of the stationary port 13 extend longer towards the front end of the shell 11 than the inside pairs of the contacts 16 of the stationary port 13 extend, the power supply connection is established before the signal communication at plug-in, and the signal communication is disconnected before the power supply at plug-out.

The invention claimed is:

1. A USB plug comprising a shell, two pairs of terminal pins, a stationary port, an upper slider, a lower slider and a levering device, wherein the shell has an opening formed at a front end thereof and the two pairs of terminal pins connected at a rear end thereof;

the stationary port extending horizontally is fixed at a middle of the rear end of the shell, each side of the stationary port having two pairs of contacts provided thereon in electrically connection with the two pairs of terminal pins correspondingly;

the upper and lower sliders respectively have first sides thereof facing towards each other and second sides thereof being slidable along upper and lower sidewalls of the shell, each one of the upper and lower sliders having two pairs of metal contacts provided on the first side thereof corresponding to the pairs of contacts provided on the stationary port;

the levering device is operatively provided between the upper and lower sliders in order to alternately shift the upper and lower sliders by means of an external intrusion force exerted on one of the upper and lower sliders, whereby when the USB plug is connected to a conventional standard USB socket in an upside or an upside down orientation, one of the sliders is retracted inwardly by an intrusion force exerted thereon while another one of the sliders is shifted outwardly by means of the levering device.

2. The USB plug according to claim 1, wherein the levering device comprises at least one gear operatively engaged between at least one upper gear rail and at least one lower gear rail.

3. The USB plug according to claim 2, wherein the at least one upper gear rail and at least one lower gear rail are respectively integrated on the first sides of the upper and lower sliders.

4. The USB plug according to claim 1, wherein each one of the metal contacts has a fixed end portion secured on the first sides of the sliders, and a curved spring end portion extending towards the rear end of the shell.

5. The USB plug according to claim 4, wherein the fixed end portions of outside pairs of the metal contacts of the sliders intended for power supply extend longer towards the front end of the shell than the fixed end portions of inside pairs of the metal contacts of the sliders intended for signal communication extend, and outside pairs of contacts of the stationary port extend longer towards the front end of the shell than inside pairs of the contacts of the stationary port extend.

* * * * *